US007978144B2

(12) United States Patent
Tanabe et al.

(10) Patent No.: US 7,978,144 B2
(45) Date of Patent: Jul. 12, 2011

(54) SECTOR ANTENNA

(75) Inventors: Kosuke Tanabe, Minato-ku (JP); Hiroyuki Yusa, Minato-ku (JP)

(73) Assignee: NEC Corporation, Tokyo (JP)

( * ) Notice: Subject to any disclaimer, the term of this patent is extended or adjusted under 35 U.S.C. 154(b) by 84 days.

(21) Appl. No.: 12/443,628

(22) PCT Filed: Apr. 28, 2008

(86) PCT No.: PCT/JP2008/058185

§ 371 (c)(1),
(2), (4) Date: Mar. 30, 2009

(87) PCT Pub. No.: WO2008/136455

PCT Pub. Date: Nov. 13, 2008

(65) Prior Publication Data

US 2010/0033396 A1 Feb. 11, 2010

(30) Foreign Application Priority Data

Apr. 27, 2007 (JP) ..... 2007-118622

(51) Int. Cl.
*H01Q 19/10* (2006.01)
*H01Q 21/12* (2006.01)

(52) U.S. Cl. ..... 343/834; 343/810; 343/812; 343/818; 343/820

(58) Field of Classification Search ..... None
See application file for complete search history.

(56) References Cited

U.S. PATENT DOCUMENTS

| | | | | |
|---|---|---|---|---|
| 4,097,868 | A * | 6/1978 | Borowick | 343/727 |
| 4,114,163 | A * | 9/1978 | Borowick | 343/815 |
| 6,239,764 | B1 * | 5/2001 | Timofeev et al. | 343/795 |
| 6,924,776 | B2 * | 8/2005 | Le et al. | 343/792.5 |
| 7,218,288 | B2 * | 5/2007 | Kimura | 343/812 |
| 7,639,198 | B2 * | 12/2009 | Timofeev et al. | 343/805 |

FOREIGN PATENT DOCUMENTS

| | | | |
|---|---|---|---|
| JP | 01-129511 | A | 5/1989 |
| JP | 05-283926 | A | 10/1993 |
| JP | 08-256013 | A | 10/1996 |
| JP | 11-308043 | A | 11/1999 |
| JP | 2000-124733 | A | 4/2000 |
| JP | 2001-251135 | A | 9/2001 |
| JP | 2003-264426 | A | 9/2003 |
| JP | 2005-033261 | A | 2/2005 |
| JP | 2005-286459 | A | 10/2005 |
| JP | 2006-191331 | A | 7/2006 |
| JP | 2006-325255 | A | 11/2006 |
| JP | 2007-019615 | A | 1/2007 |
| JP | 2007-060062 | A | 3/2007 |

* cited by examiner

*Primary Examiner* — Trinh V Dinh
(74) *Attorney, Agent, or Firm* — Sughrue Mion, PLLC

(57) ABSTRACT

A first printed circuit board for vertical polarized wave has a plurality of vertical polarized wave elements which serves as antenna elements, and a first feeder circuit which is connected to the plurality of vertical polarized wave elements. A second printed circuit board for horizontal polarized wave has a second feeder circuit which is connected to a plurality of horizontal polarized wave elements which serves as antenna elements, and is mounted with the plurality of horizontal polarized wave elements. A cutout portion is provided between the adjacent two vertical polarized wave elements of the first printed circuit board, and the first and second printed circuit boards are arranged parallel so that the horizontal polarized wave elements are arranged in the cutout portions of the first printed circuit board. A reflecting plate has a concave section extending to one direction, and the plurality of vertical polarized wave elements and the plurality of horizontal polarized wave elements are arranged alternately in one direction inside the concave section.

15 Claims, 15 Drawing Sheets

SECTOR ANTENNA

TECHNICAL FIELD

The present invention relates to a sector antenna and particularly, relates to the sector antenna used as a base station antenna of a wireless system such as a mobile telephone, a wireless LAN (local area network), WiMAX (worldwide interoperability for microwave access). This application is a 371 of PCT/JP2008/058185 filed Apr. 4, 2008, which insists the benefit of priority based on Japanese Patent Application No. 2007-118622 filed on Apr. 27, 2007. Contents of this specification incorporates the contents of the Japanese Patent Application No. 2007-118622.

BACKGROUND ART

One example of base station antennas utilizing a wireless system such as a mobile telephone, a wireless LAN or WiMAX, particularly an MIMO (multi input multi output) system is a sector antenna which patch antennas for orthogonal polarized waves are arranged.

As the antenna for orthogonal polarized waves, the following constitution is proposed. Patent Document 1 describes a constitution of a two-frequency shared dipole antenna apparatus, and Patent Document 2 discloses a multi-frequency polarized wave shared antenna apparatus or a single frequency antenna apparatus.

Patent Document 1: JP-A 2006-325255 (Japanese Patent Application Laid-Open No. 2006-325255)

Patent Document 2: JP-A 2005-33261 (Japanese Patent Application Laid-Open No. 2005-33261)

DISCLOSURE OF THE INVENTION

Problem to be Solved by the Invention

Since a sector antenna which patch antennas are arranged has a constitution such that horizontal polarized wave elements are arranged on both sides of a vertical polarized wave element in Patent Document 1, respectively (FIG. 10 in Patent Document 1), the antenna constitution becomes complicated. In the constitution of the Patent Document 2, since a plurality of vertical polarized wave elements are arranged in one direction and horizontal polarized wave elements are arranged on a direction vertical to the one direction (FIG. 3 in Patent Document 2), the antenna constitution becomes complicated and the number of parts increases.

Therefore, it is desired that an antenna, which has a simple constitution and a low manufacturing cost and are shared by vertical and horizontal polarized waves, is realized.

In view of the above problem, it is an exemplary object of the present invention to provide a sector antenna whose constitution is simplified.

Means to Solve the Problem

A sector antenna of the present invention includes:

a first printed circuit board for vertical polarized wave, the first printed circuit including a plurality of vertical polarized wave elements and a first feeder circuit connected to the plurality of vertical polarized wave elements;

a second printed circuit board for horizontal polarized wave, the second printed circuit board being mounted with a plurality of horizontal polarized wave elements and including a second feeder circuit connected to the plurality of horizontal polarized wave elements; and a reflecting plate which includes a concave section extending to one direction, wherein a cutout portion is provided between the adjacent two vertical polarized wave elements of the first printed circuit board, the first printed circuit board and the second printed circuit board are arranged parallel so that the horizontal polarized wave elements are arranged at the cutout portions of the first printed circuit board, the plurality of vertical polarized wave elements and the plurality of horizontal polarized wave elements are arranged alternately in the one direction inside the concave section.

EFFECT OF THE INVENTION

According to the present invention, the printed circuit board is used for vertical polarized waves and the printed circuit board mounted with the horizontal polarized wave elements is used for horizontal polarized waves, the constitutions of the feeder circuit and antenna elements can be constituted simply.

| DESCRIPTION OF REFERENCE SYMBOLS | |
|---|---|
| 11, 12: | printed circuit board |
| 13, 17: | balun |
| 14: | vertical polarized wave element |
| 15: | horizontal polarized wave element |
| 16, 18: | feeder circuit |
| 19: | ground conductor |
| 24: | diagonal element |
| 20, 21, 22, 40: | reflecting plate |
| 30: | support plate |

BEST MODE FOR CARRYING OUT THE INVENTION

A sector antenna according to an exemplary embodiment of the present invention is descried below with reference to the drawings.

First Embodiment

Figure 1:
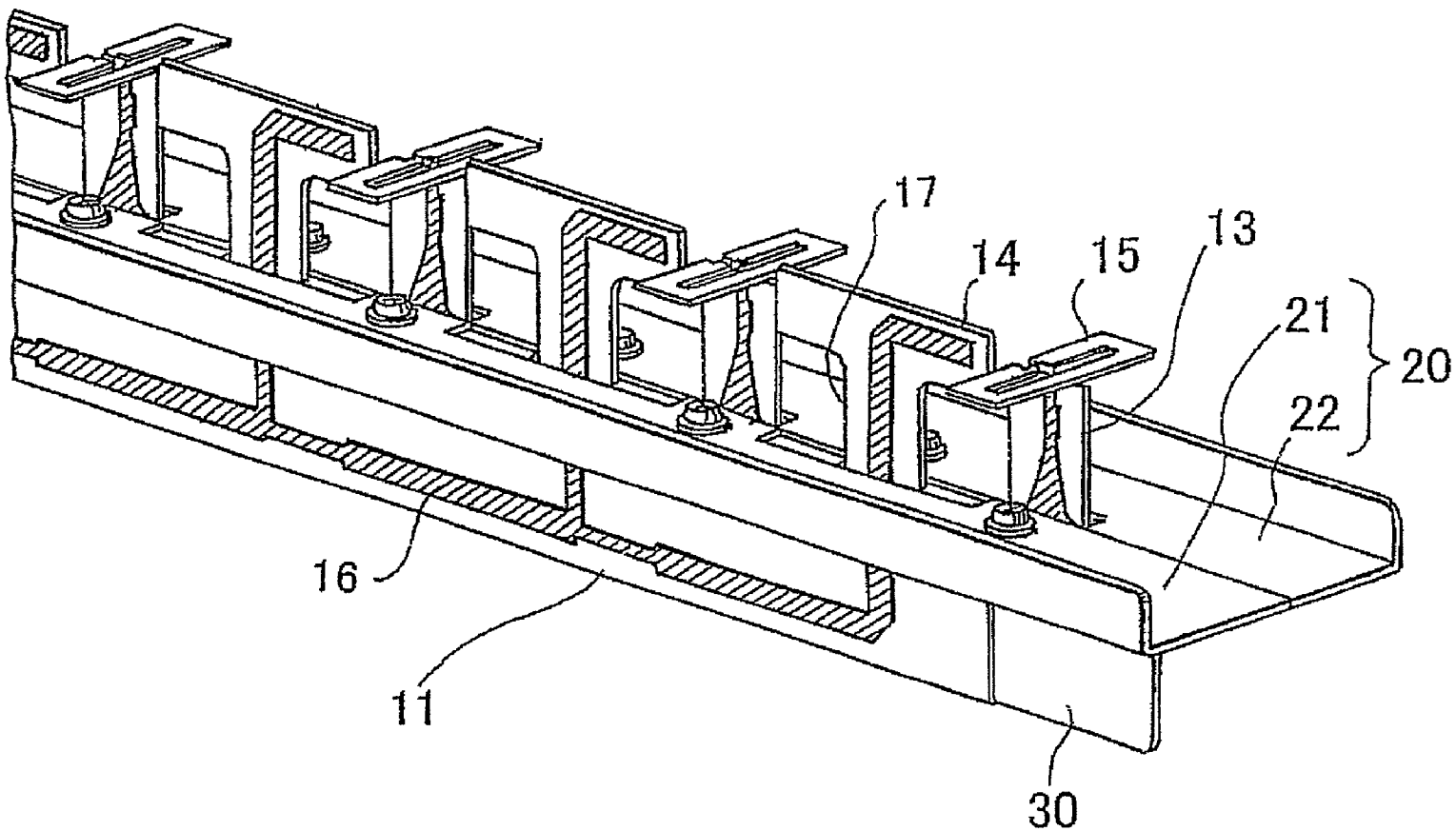
FIG. 1 is a perspective view illustrating a sector antenna according to a first embodiment of the present invention.
Figure 2:
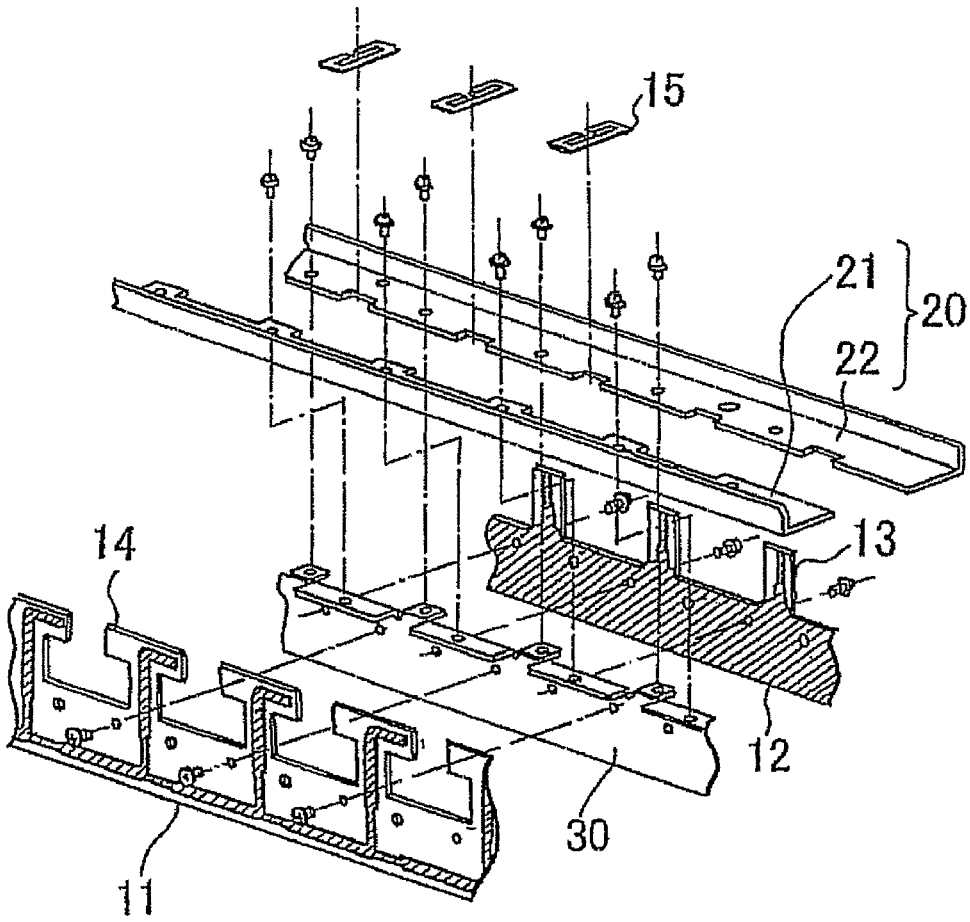
FIG. 2 is an exploded perspective view illustrating the exploded structure of the sector antenna according to the first embodiment of the present invention.

FIG. 1 is a perspective view illustrating a sector antenna according to a first embodiment of the present invention. FIG. 2 is an exploded perspective view illustrating the exploded structure of the sector antenna according to the first embodiment.

The sector antenna shown in FIGS. 1 and 2 includes a printed circuit board 11, a printed circuit board 12, horizontal polarized wave elements 15, a reflecting plate 21, a reflecting plate 22, and a support plate 30. The reflecting plate 21 and the reflecting plate 22 are combined so as to compose a reflecting plate 20.

Figure 3:
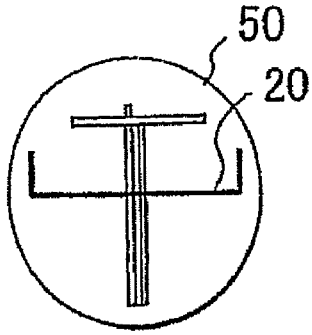
FIG. 3 is a diagram illustrating a cylindrical radome which houses the sector antenna according to the first embodiment of the present invention.

FIG. 3 is a diagram illustrating a cylindrical radome which houses the sector antenna. The sector antenna shown in FIGS. 1 and 2 is housed in the cylindrical radome 50.

Figure 12:
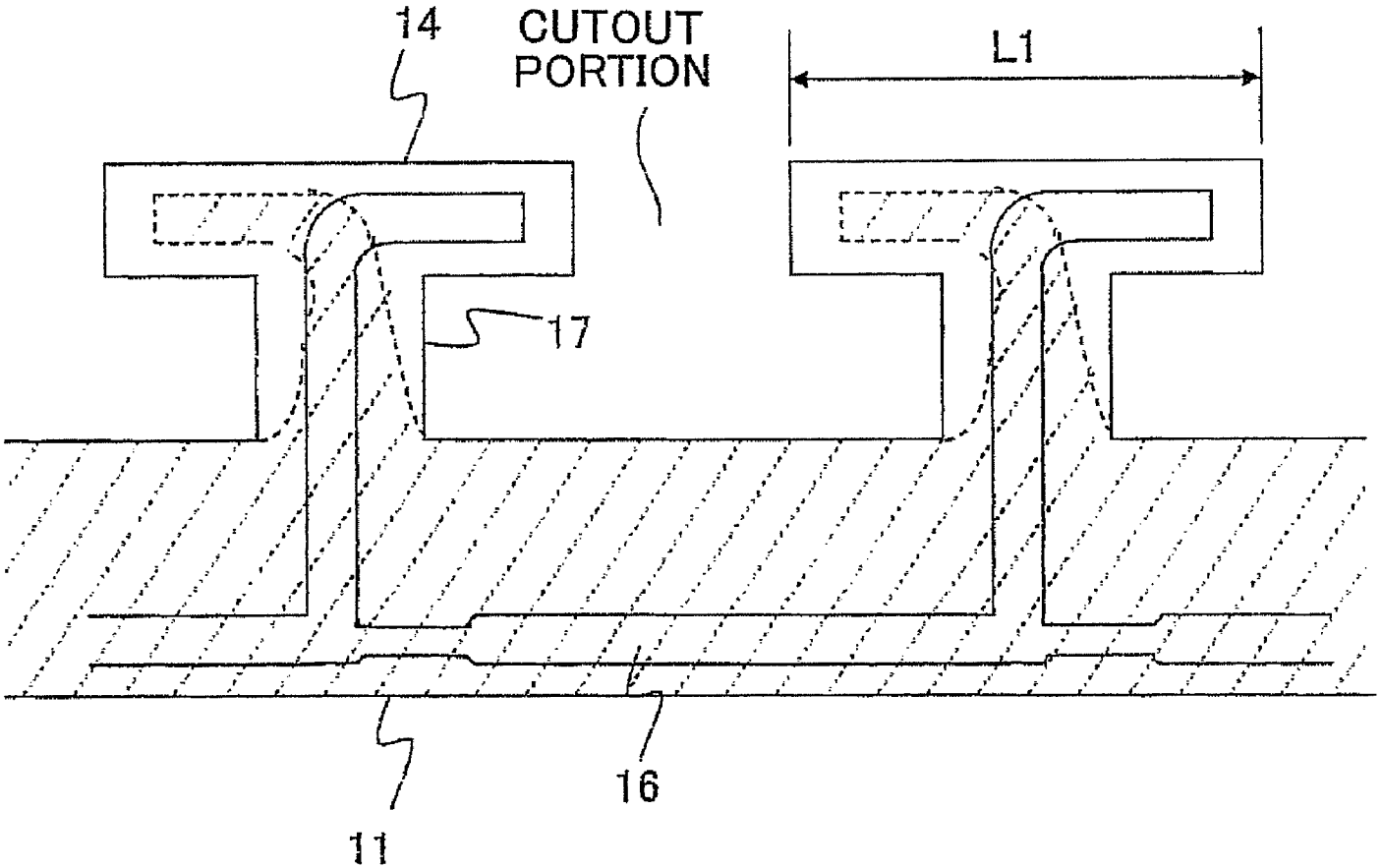
FIG. 12 is a plan view illustrating a printed circuit board 11.

As shown in FIGS. 1 and 2, the printed circuit board 11 constructs vertical polarized wave elements 14, a feeder circuit 16 and a balun 17. FIG. 12 is a plan view illustrating the printed circuit board 11.

A surface of the feeder circuit 16 is a microstrip line, and its rear surface has a ground conductor.

A surface of the balun 17 is a strip line and its rear surface is formed by a tapered ground conductor.

The vertical polarized wave element 14 is formed with a dipole, and the dipole is formed by copper foil formed on front and rear sides of the printed circuit board 11. A length L1 (in FIG. 12) of the vertical polarized wave element 14 is suitably about 0.4 times wavelength.

Figure 13:
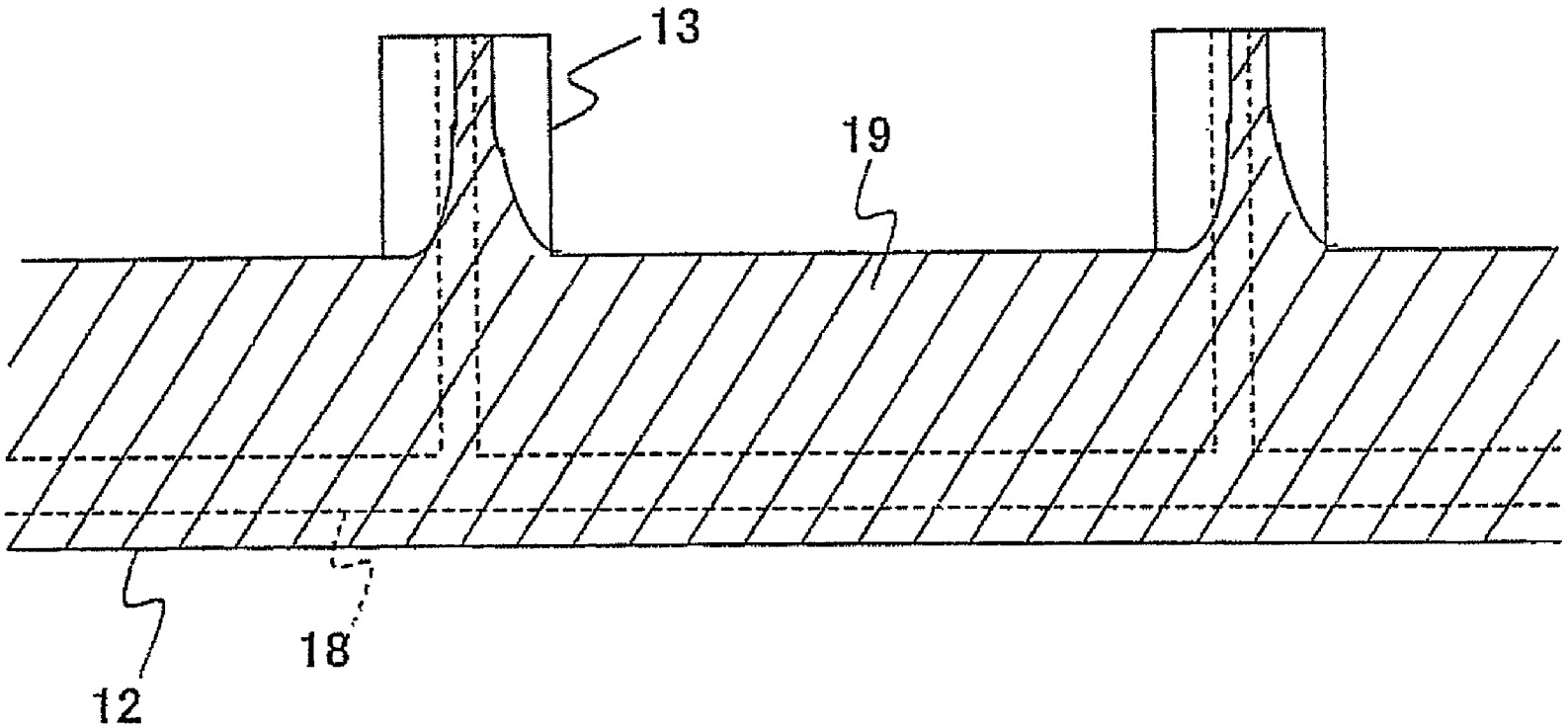
FIG. 13 is a plan view illustrating a printed circuit board 12.

The printed circuit board 12 constructs a feeder circuit 18 and a balun 13. FIG. 13 is a plan view illustrating the printed circuit board 12. FIG. 13 illustrates a rear surface of the printed circuit board 12, and a ground conductor 19 is formed on the rear surface.

Similarly to the feeder circuit 16 of the printed circuit board 11, a surface of the feeder circuit 18 is a microstrip line, and its rear surface includes the ground conductor 19.

A front surface of the balun 13 is a strip line and its rear surface is formed by a tapered ground conductor.

The horizontal polarized wave element 15 is formed by a plate and has a shape such that a linear element is folded back, and has a folding-back dipole.

Figure 14:
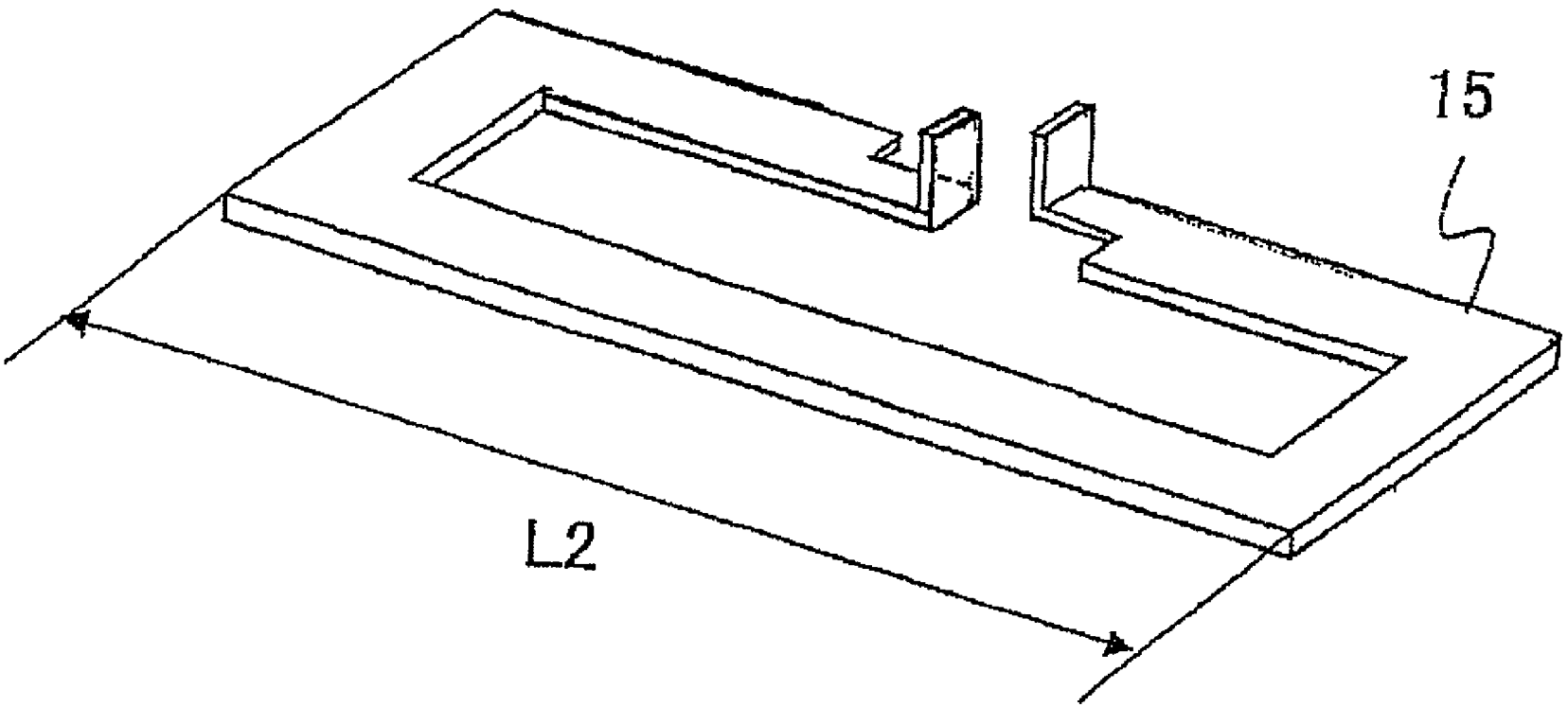
FIG. 14 is a perspective view illustrating a horizontal polarized wave element 15.

FIG. 14 is a perspective view illustrating the horizontal polarized wave element 15, and its both ends are folded. One of both the ends is connected to the surface of the balun of the printed circuit board 12, and the other end is connected to the rear surface of the balun by soldering.

A length L2 (shown in FIG. 14) of a long side of the horizontal polarized wave element 15 is about 0.35 to 0.5 times wavelength, and more preferably about 0.45 times wavelength.

As a material of the printed circuit boards 11 and 12, PTFE (Polytetrafluoroethylene) is suitable due to low loss, but materials such as BT resin (bismaleimide triazine resin) and PPE (polyphenyleneether) can be also used in order to reduce the cost of the material.

The reflecting plates 21 and 22 are formed by plates whose cross sections have an L shape, and partially have cutouts through which the printed circuit board 11 and the baluns 13 of the printed circuit board 12 are put. The cutouts of the reflecting plate 21 and the cutouts of the reflecting plate 22 are combined so as to compose holes of the reflecting plate 20 through which the printed circuit board 11 and the baluns 13 of the printed circuit board 12 are put. The reflecting plate 20 in which the reflecting plates 21 and 22 are combined has a "]"-shaped cross section, and a concave section which extends to one direction is formed. A plurality of vertical polarized wave elements and a plurality of horizontal polarized elements are arranged alternately in one direction inside the concave section.

The support plate 30 is formed by a plate, and its end portions are folded alternately, and has tabs for fixing the reflecting plate 21 or 22.

The printed circuit boards 11 and 12, the reflecting plates 21 and 22 and the support plate 30 are fixed by screws.

The sector antenna including the above structures is housed in the cylindrical radome shown in FIG. 3. A diameter of the radome is preferable about 0.8 to 1 times the use wavelength.

The vertical polarized wave elements 14 formed on the printed circuit board 11 and the horizontal polarized wave elements 15 mounted to the printed circuit board 12 are arranged alternately in one linear shape. The number and the interval of the arrangement are determined by desired property. A cutout portion (shown in FIG. 12) is provided between the two vertical polarized wave elements 14 adjacent on the printed circuit board 11, and the printed circuit boards 11 and 12 are arranged parallel so that the horizontal polarized wave elements 15 are provided in the cutout portions of the printed circuit board 11, respectively.

An amplitude and a phase of a signal fed to each arrangement are controlled by the feeder circuit so as that a desired property is obtained. For example in this embodiment, branches of the microstrip line are used to distribute a signal in series, so that the amplitude and the phase are controlled. An example of the control of the amplitude and the phase using the feeder circuit is described in JP-A 7-183724 (Japanese Patent Application Laid-Open No. 7-183724).

Figure 4:
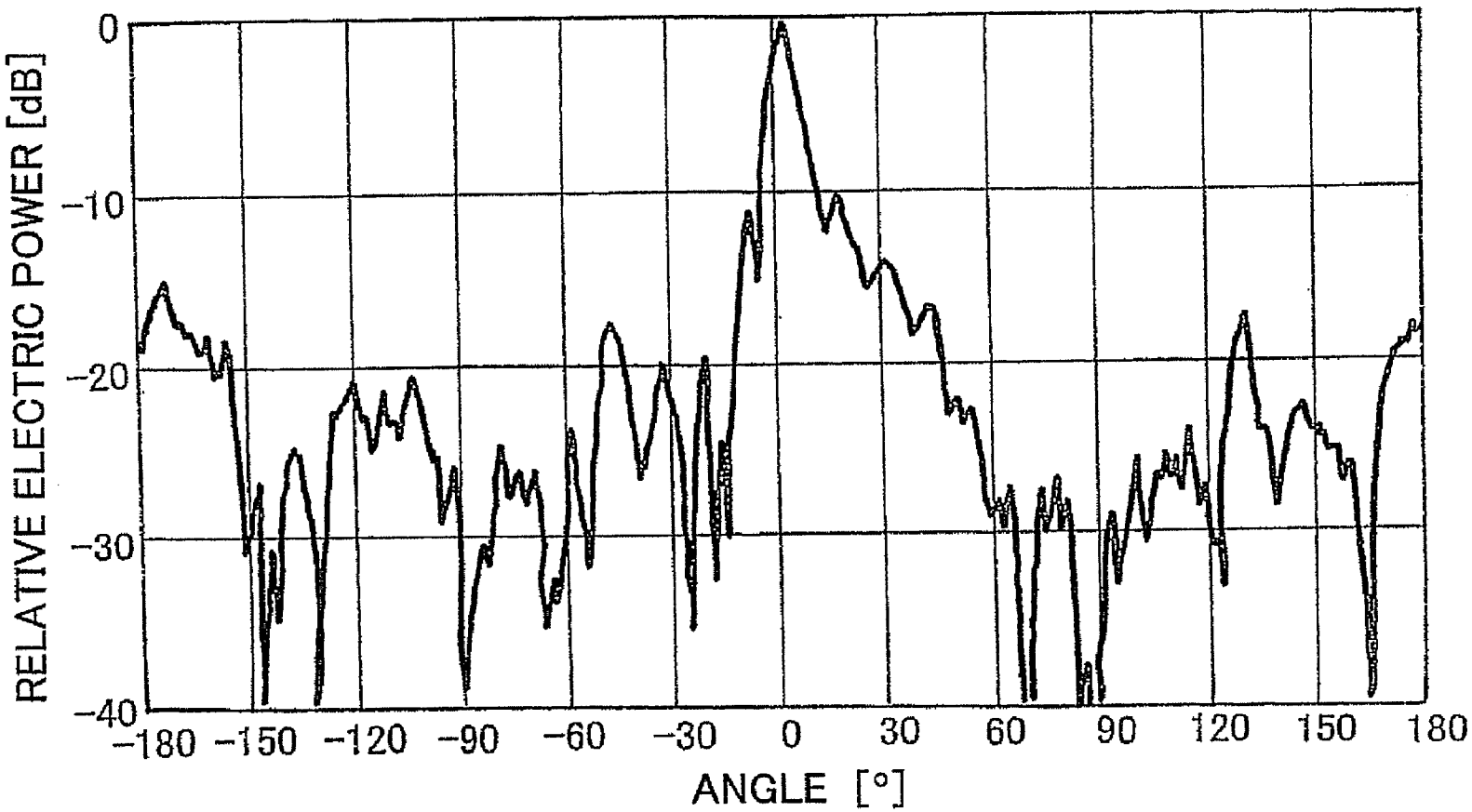
FIG. 4 is a diagram illustrating a radiation pattern of a vertical surface according to the first embodiment of the present invention.

FIG. 4 is a diagram illustrating a radiation pattern of a vertical surface according to the embodiment.

Figure 5:
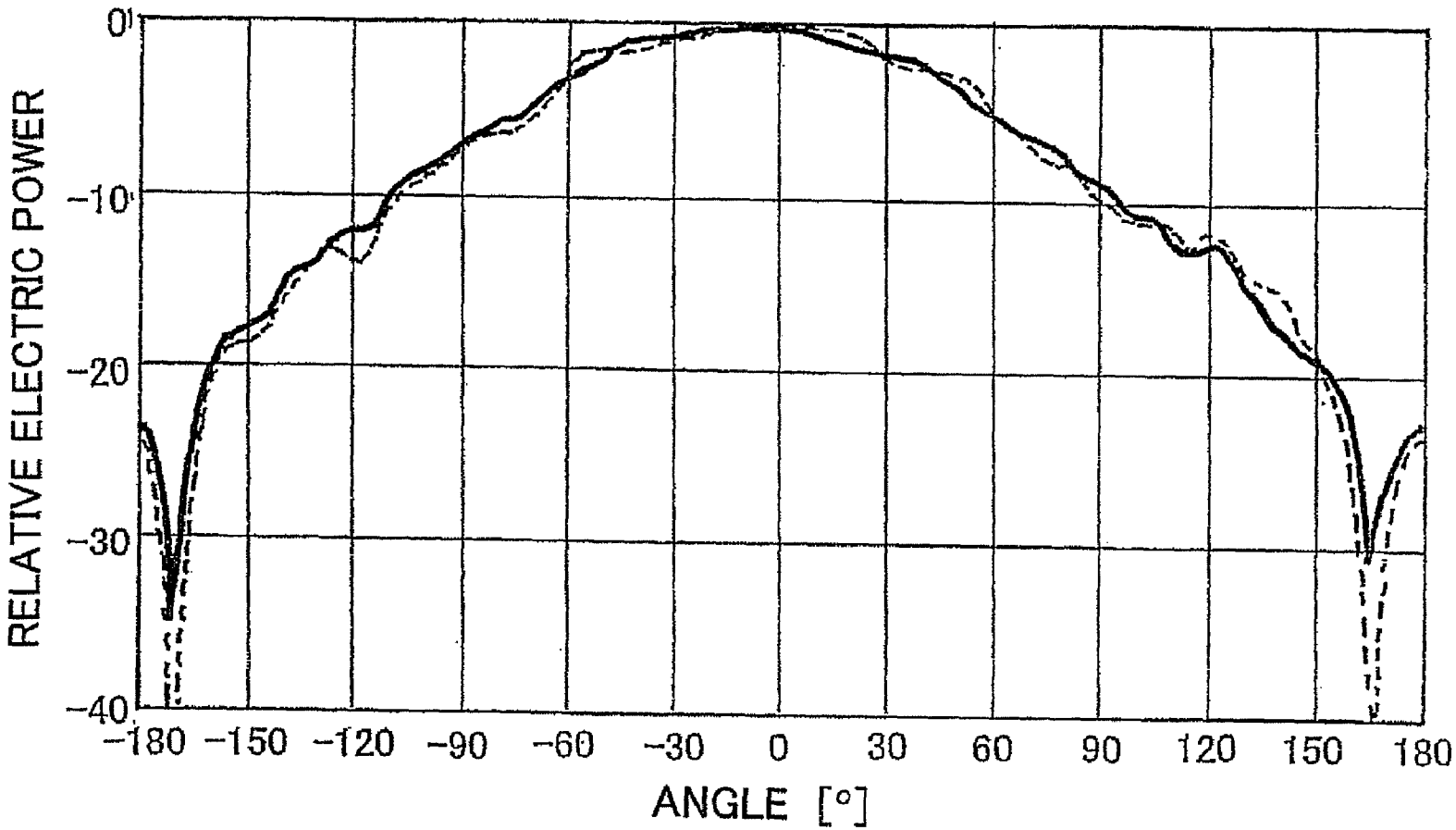
FIG. 5 is a diagram illustrating a radiation pattern of a horizontal surface according to the first embodiment of the present invention.

FIG. 5 is a diagram illustrating a radiation pattern of a horizontal surface according to the embodiment.

In this embodiment of the present invention, since both the vertical polarized wave and the horizontal polarized wave are used, the sector antenna can be applied to an MIMO system utilizing polarized waves.

The sector antenna according to the embodiment has a sector beam in a peripheral direction and a pencil beam or a null-fill beam (cosecant square-law characteristic) in a vertical direction.

An operation for transmitting a vertical polarized wave according to this embodiment is described along a flow of a microwave signal.

A microwave signal input from an input/output port for the vertical polarized wave passes through the branches of the microstrip line, and is distributed in distribution ratio with suitable amplitude and phase.

The suitably distributed microwave signal is converted from an unbalanced signal into a balanced signal by a balun.

The microwave signal converted into the balanced signal is fed to the vertical polarized elements 14 so that microwaves are radiated to a space.

The microwaves radiated from the vertical polarized waves 14 form a desirable pattern at a far distance.

In this embodiment, the horizontal surface has a sector beam, and the vertical surface has a cosecant square-law beam.

Since an operation for transmitting the horizontal polarized wave in this embodiment is the same as the case of the vertical polarized wave elements 14 except that the antenna elements are the horizontal polarized wave elements 15, detailed description thereof is omitted.

Since a receiving operation according to the embodiment is the same as the case of the transmission except that the flow of the microwave signal is reversed, detailed description thereof is omitted.

In the sector antenna according to this embodiment, as to the method for constituting the feeder circuit and the antenna elements, the printed circuit board of the vertical polarized wave elements is used for the vertical polarized waves, and the printed circuit board mounted with the horizontal polarized wave elements is used for the horizontal polarized waves.

As a result, the sector antenna according to the first embodiment can be formed so that the feeder circuit and the antenna elements have a simple constitution.

Since the vertical polarized wave elements and the horizontal polarized wave elements are arranged in one linear shape and they can share the reflecting plate, the sector antenna according to this embodiment can be housed in the cylindrical radome with diameter of about 0.8 times wavelength.

As a result, the sector antenna can be miniaturized.

Since the sector antenna according to this embodiment is constituted by less number of parts, the price of the parts is inexpensive, and since its constitution is simple, the assembly is easy and a manufacturing cost can be reduced.

Second Embodiment

Figure 6:
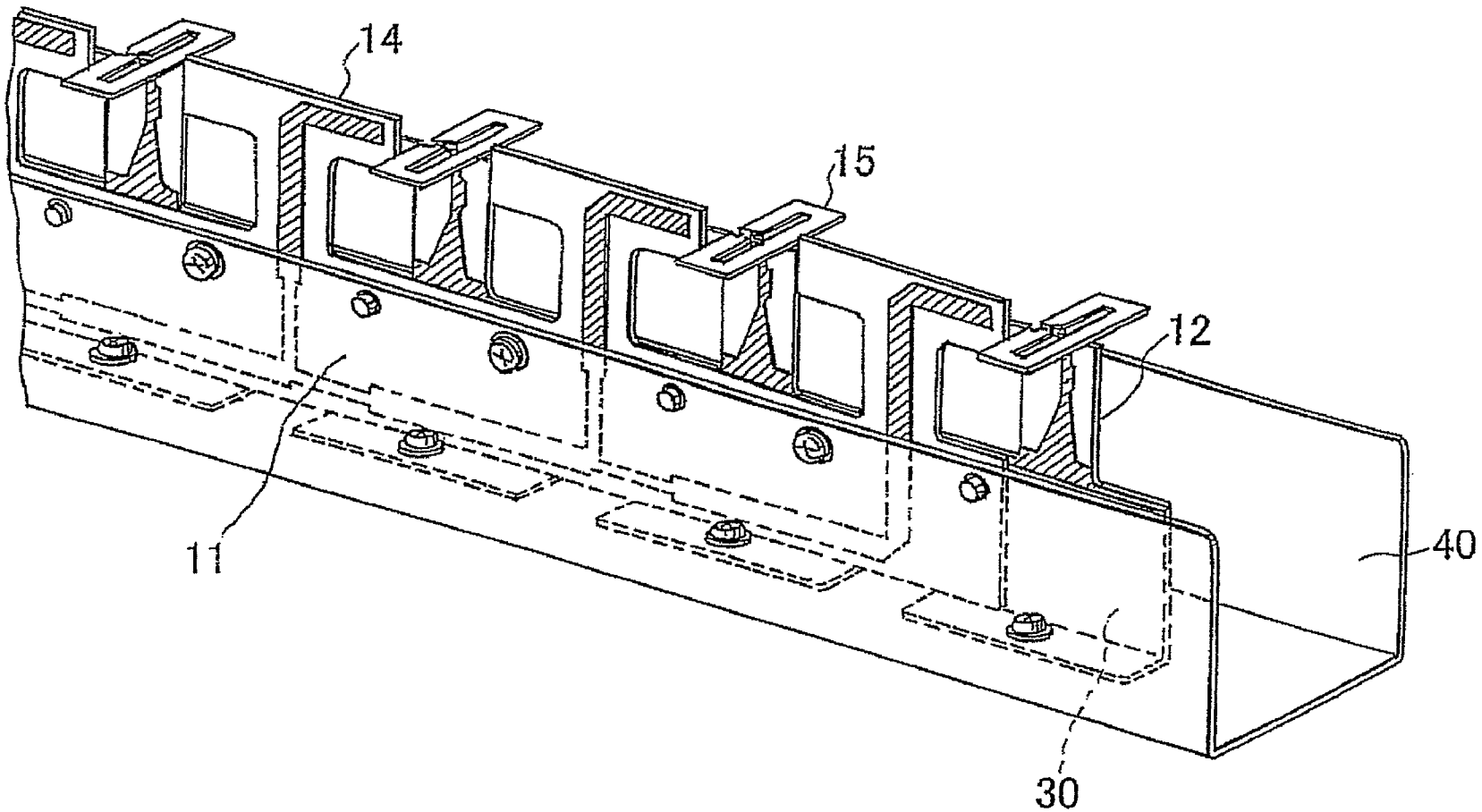
FIG. 6 is a perspective view illustrating the sector antenna according to a second embodiment of the present invention.

The sector antenna according to a second embodiment of the present invention is described below with reference to the drawings. FIG. 6 is a perspective view illustrating the sector antenna according to the second embodiment of the present invention.

The sector antenna shown in FIG. 6 includes the printed circuit boards 11 and 12, the horizontal polarized wave elements 15, a reflecting plate 40, and the support plate 30. The support plate 30 is not limited to the one having a size shown in FIG. 6, but may be a small fitting such as an L-shaped fitting. The vertical polarized elements 14 are constituted by a part of the printed circuit board 11.

The second embodiment shown in FIG. 6 is different from the first embodiment shown in FIG. 1 in that the printed circuit boards 11 and 12 and the support plate 30 are arranged inside the reflecting plate 40.

Accordingly, shapes of the following parts are simplified.

In the first embodiment, the reflecting plates 21 and 22 are provided with the cutouts through which the printed circuit boards 11 and 12 are put. That is to say, the hole through which the printed circuit boards 11 and 12 are put is provided to the reflecting plate 20. In this embodiment, it is not necessary that the reflecting plate 40 is provided with the hole, and thus the shape is simplified.

As a size of the printed circuit boards 11 and 12, a distance in a short-side direction (distance from the reflecting plate 40 to the vertical polarized wave element 14 or the horizontal polarized wave element 15) can be made to be shorter than the printed circuit boards 11 and 12 in the first embodiment. For this reason, areas of the printed circuit boards 11 and 12 can be narrower than those in the first embodiment.

According to this embodiment, the parts of the sector antenna are simplified so that the costs of the parts and assembly can be reduced.

The radiation pattern of the vertical surface in this embodiment is similar to that in the first embodiment.

On the other hand, as to the radiation pattern of the horizontal surface in this embodiment, a positional relationship of a shape between the vertical polarized wave element or the horizontal polarized wave element and the reflecting plate is different from that in the first embodiment. For this reason, the radiation pattern has a different beam width. However, a desired beam width can be achieved by adjusting the shape of the reflecting plate and the position of the elements.

Third Embodiment

FIGS. 7A to 7C, 8A to 8C and 9A to 9C illustrate the embodiment when the shape of the reflecting plate 20 in the first embodiment is changed. In this application, a substantially zygal (H character) shape also includes shapes of reflecting plates 20-1 to 20-9 shown in FIGS. 7A to 7C, 8A to 8C and 9A to 9C. The reflecting plate 40 in the second embodiment may have the same shape as those of the reflecting plates 20-1 to 20-9.

According to this embodiment, an electric current flowing on the end portion of the reflecting plate 40 is restrained, so that a back lobe property, particularly, a back lobe property of the horizontal polarized waves is improved.

The other effects and operations are similar to those in the first embodiment.

Figure 7A:
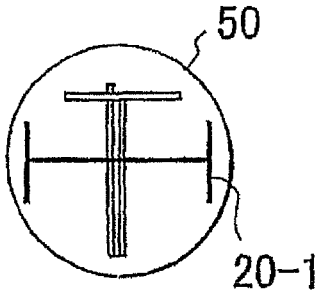
FIG. 7 is a diagram illustrating a cross-sectional shape of a reflecting plate according to a third embodiment of the present invention.

In the embodiment in FIG. 7A, the cross-sectional shape of the reflecting plate 20 in the first embodiment is changed into an H shape of the reflecting plate 20-1.

According to this embodiment, radiowave scattering to a backward (side opposite to the arrangement side of the vertical polarized wave elements and the horizontal polarized wave elements with respect the reflecting plate) can be restrained further than the first embodiment, so that the back lobe can be reduced.

The antenna in this embodiment is housed in the cylindrical radome 50, but the shape of the reflecting plate should be enough small to be stored in the radome in order to decrease the diameter of the radome as much as possible.

Figure 7B:
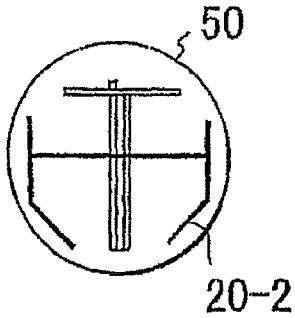

In the embodiment of FIG. 7B, the reflecting plate is folded so as to be capable of being stored in the radome and is extended to a backward as compared with the one in FIG. 7A, so that the reflecting plate 20-2 is obtained. As a result, the radiowave scattering can be restrained further than FIG. 7A.

A length of H-shaped side surface is preferably about ¼ or more of a use wavelength.

Figure 7C:
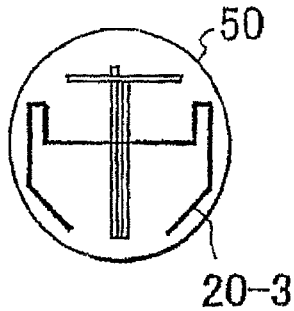
Figure 15:
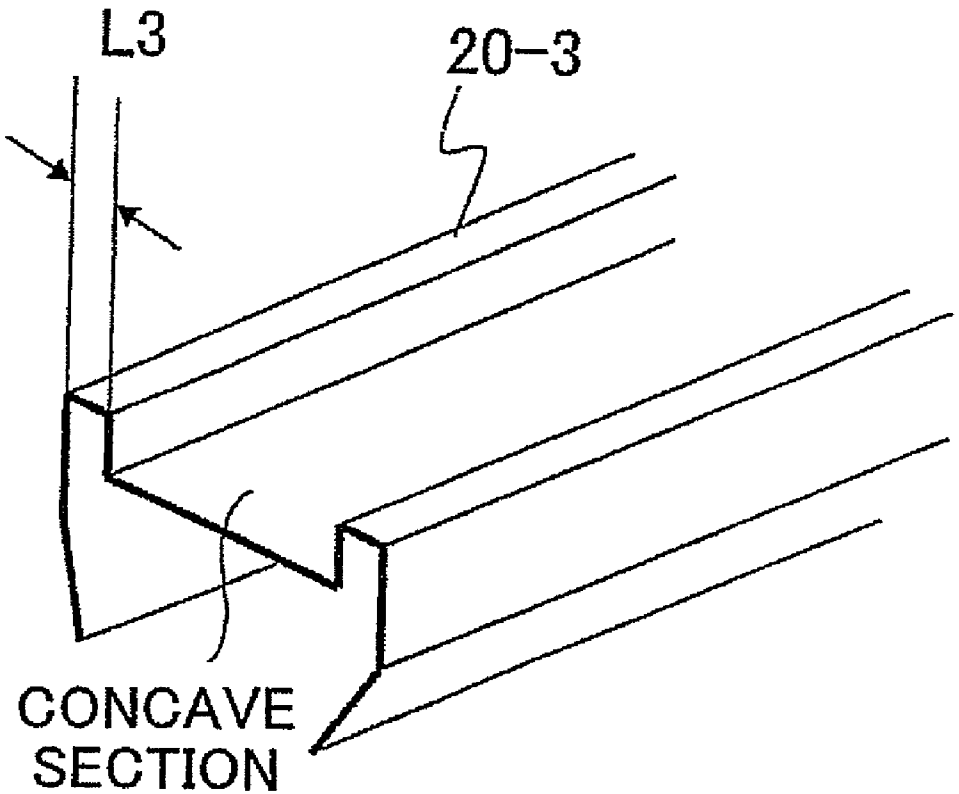
FIG. 15 is a perspective view illustrating a reflecting plate 20-3.

In the embodiment of FIG. 7C, a thickness is given partially so as to be thicker than the thickness of the reflecting plate in FIG. 7B (the side surface of the concave section is folded back so as to be thick) so that the reflecting plate 20-3 is obtained. As a result, the scattering from the end portion of the reflecting plate is further restrained. FIG. 15 is a perspective view of the reflecting plate 20-3. A thickness L3 becomes thicker than the thickness of the reflecting plate.

Figure 8A:
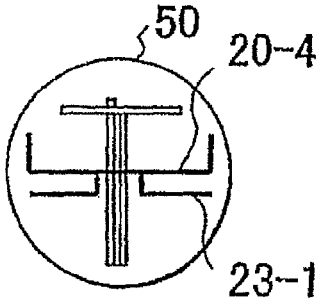
FIG. 8 is a diagram illustrating a cross-sectional shape of the reflecting plate according to the third embodiment of the present invention.

In the embodiment of FIG. 8A, a choke 23-1 is provided to a plane of the reflecting plate 20-4 so that an electric current flowing on the rear surface of the reflecting plate is suppressed.

A depth of the choke may be about ¼ of the use wavelength.

Figure 8B:
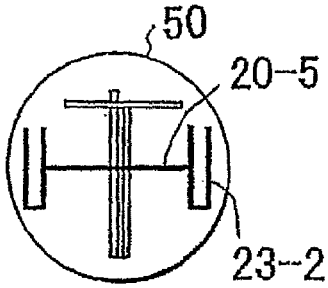

In the embodiment of FIG. 8B, a choke 23-2 is provided to the side surface of the H type reflecting plate 20-5.

As a result, an electric current on the end portion of the reflecting plate is suppressed.

Figure 8C:
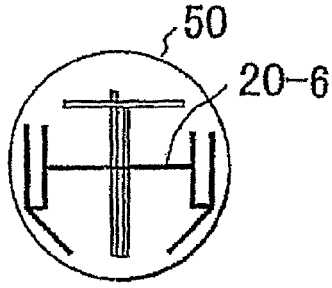

In the embodiment of FIG. 8C, the reflecting plate in the embodiment of FIG. 8B is extended to a backward so that the reflecting plate 20-6 is obtained.

As a result, the radiowave scattering is restrained further than the embodiment of FIG. 8B.

Figure 9A:
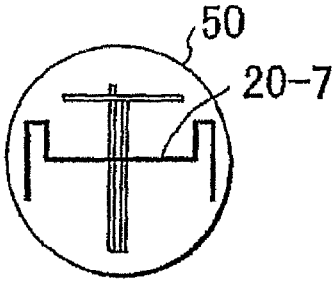
FIG. 9 is a diagram illustrating a cross-sectional shape of the reflecting plate according to the third embodiment of the present invention.

In the embodiment of FIG. 9A, a thickness of the side surface of the H type reflecting plate 20-7 is thick.

As a result, the scattering from the end portion of the reflecting plate is restrained.

Figure 9B:
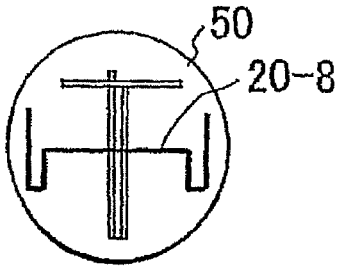

In the embodiment of FIG. 9B, the reflecting plate in the embodiment shown in FIG. 9A is set upside down so that the reflecting plate 20-8 is obtained.

As a result, the similar effect to the embodiment in FIG. 9A is produced.

Figure 9C:
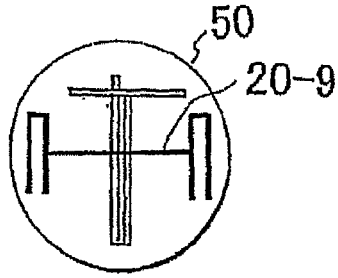

In the embodiment of FIG. 9C, the reflecting plate in the embodiment of FIG. 8B is constituted upside down so that the reflecting plate 20-9 is obtained.

As a result, the similar effect to that in the embodiment of FIG. 8B is produced.

Fourth Embodiment

Figure 10:
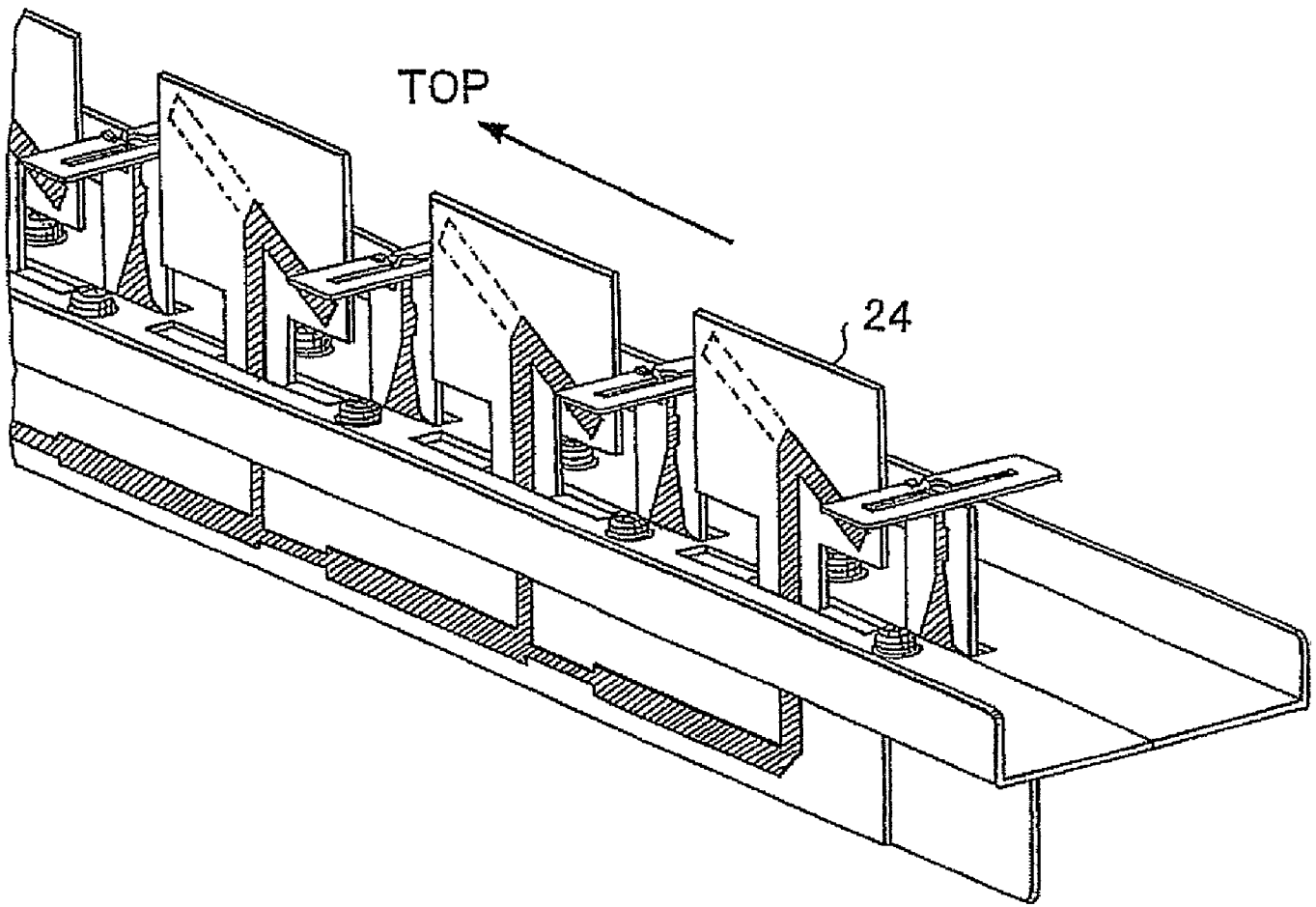
FIG. 10 is a perspective view illustrating the sector antenna when a diagonal element according to a fourth embodiment of the present invention is formed.

The sector antenna according to a fourth embodiment is shown in FIG. 10.

In the sector antenna in FIG. 10, the vertical polarized wave elements 14 of the sector antenna in the first embodiment of FIG. 1 are arranged diagonally, so that diagonal elements 24 (also as V polarized wave elements) are formed.

A downward tilting angle at the time when the vertical polarized wave elements 14 are arranged diagonally so that the diagonal elements 24 are formed (angle of diagonal arrangement) is preferably up to about 40° with respect to a direction of TOP shown in FIG. 10. The direction of TOP is an upward direction with respect to a ground when the sector antenna is arranged vertically with respect to the ground.

Further, it is more desirable that the vertical polarized wave elements 14 are tilted about 30° with respect to the direction of TOP shown in FIG. 10 and the diagonal elements 24 are formed.

Figure 11:
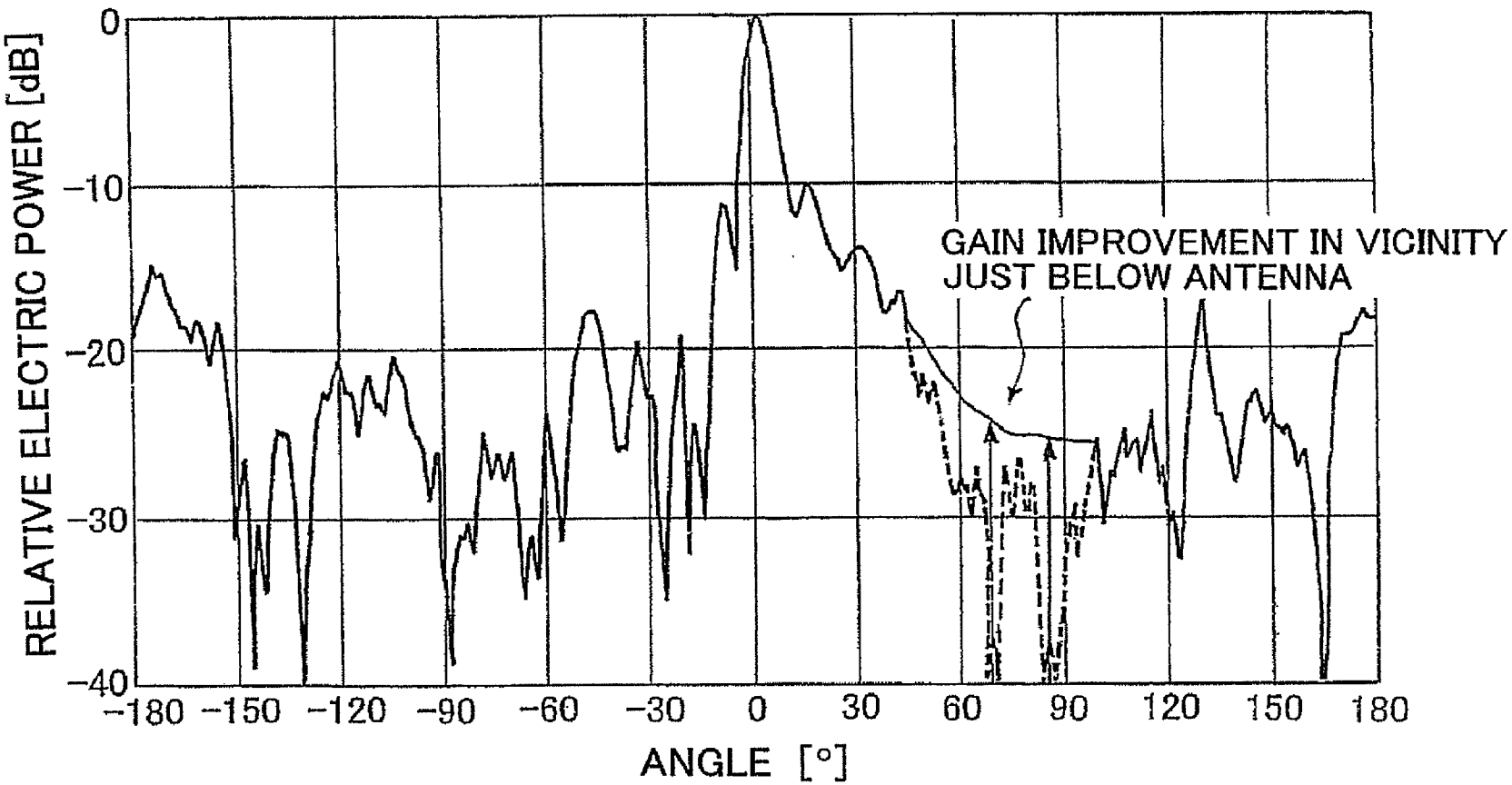
FIG. 11 is a diagram illustrating the radiating pattern of the vertical surface when the diagonal element according to the fourth embodiment of the present invention is formed.

FIG. 11 is a characteristic chart illustrating a gain improvement of the radiation pattern of the vertical surface in the sector antenna formed with the diagonal elements 24 shown in FIG. 10.

As shown by an arrow in the drawing, the radiation pattern of the vertical surface in the fourth embodiment shown in FIG. 11 indicates that the gain is improved on a vicinity just below the sector antenna further than the radiation pattern of the vertical surface in the first embodiment shown in FIG. 4.

That is to say, as shown in FIG. 11, the diagonal elements 24 in FIG. 10 are formed, so that the gain in the vicinity just below the sector antenna (particularly the vicinity of 60° to 90° in FIG. 11) can be greatly improved.

As a result, the sector antenna formed with the diagonal elements 24 can improve a radiowave environment (communication condition) on the vicinity just below the sector antenna.

Figure 16A:
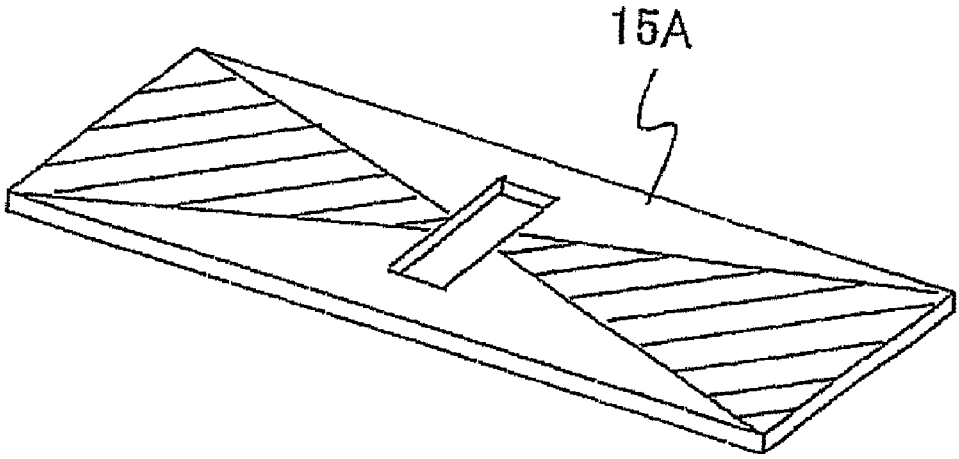
FIG. 16 is a perspective view illustrating an example where the horizontal polarized wave element is formed on the printed circuit board by using copper foil.
Figure 16B:
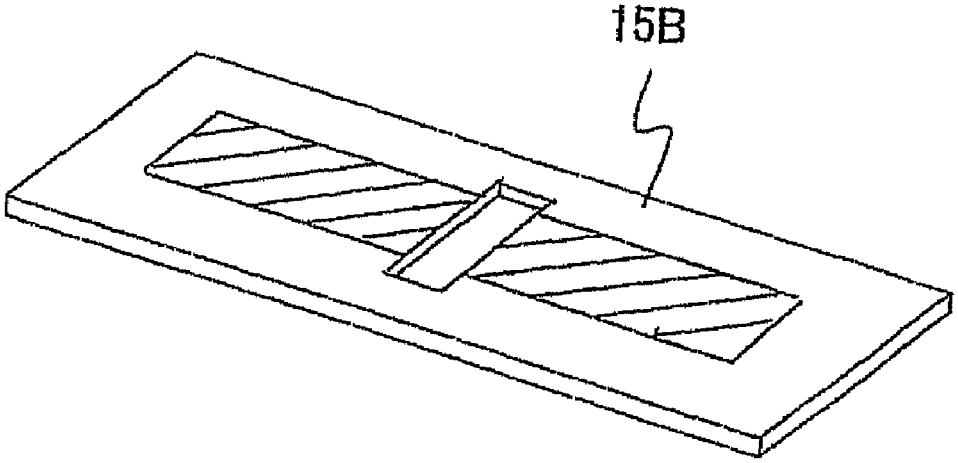
Figure 17:
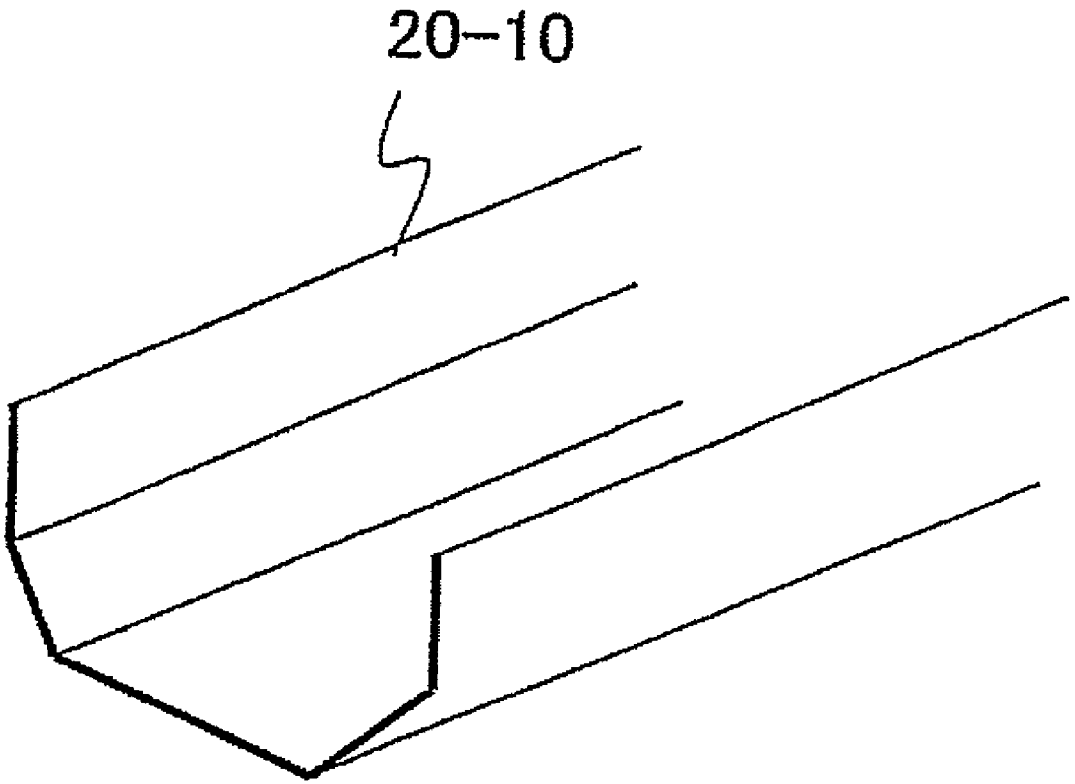
FIG. 17 is a perspective view illustrating a modified example of the reflecting plate 20 or 40.
Figure 18:
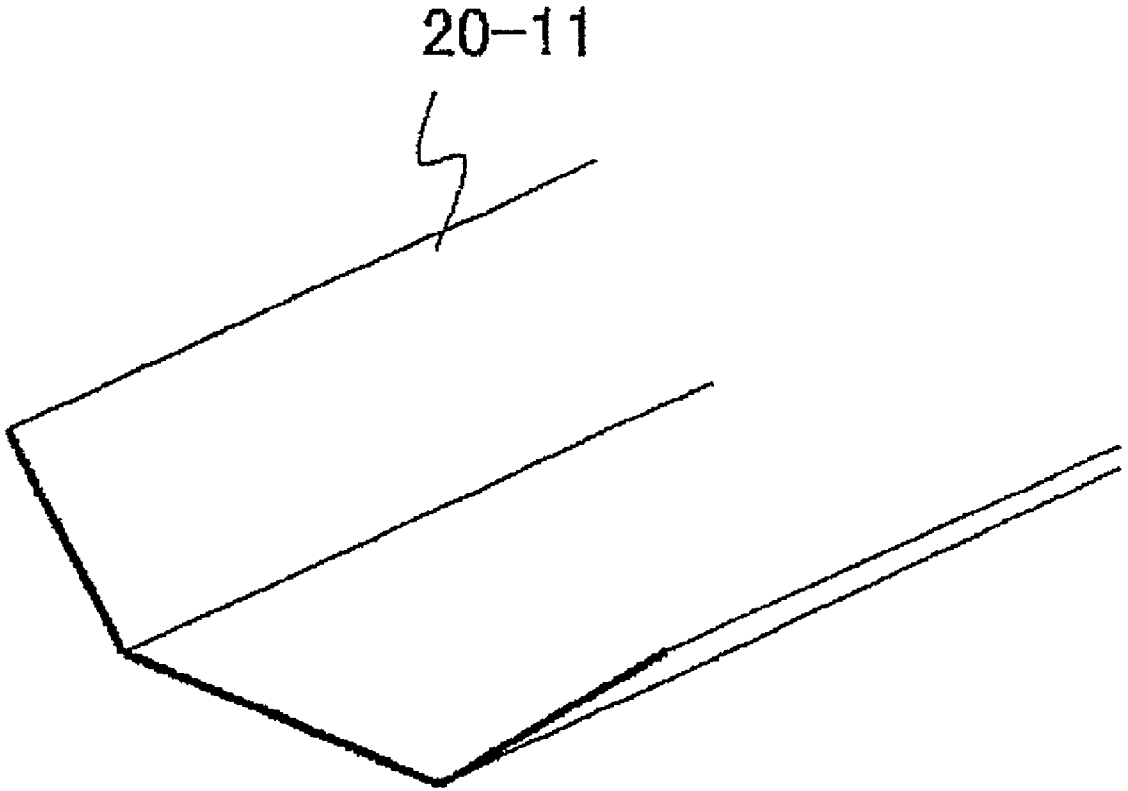
FIG. 18 is a perspective view illustrating another modified example of the reflecting plate 20 or 40.

In the above embodiments, the horizontal polarized wave elements 15 are formed by a plate, but may be formed by a printed circuit board. FIGS. 16A and 16B illustrate examples where the horizontal polarized wave elements are formed by copper foil on printed circuit boards 15A and 15B. Centers of the printed circuit boards 15A and 15B are opened, and the horizontal polarized wave elements formed by the copper foil are connected to the baluns of the printed circuit board 12 by soldering. Further, the reflecting plate 20 has the "]" shape, but a reflecting plate 20-11 having a "⌋" shape shown in FIG. 18 obtained by deforming the "]"-shaped reflecting plate 20 may be used. As shown in FIG. 17, a reflecting plate 20-10 whose cross-sectional shape is such that the end portion of the "⌋" shape is folded and extended may be used. In this application, the substantially "]" shape (substantially square bracket shape) includes the "⌋" shape (both ends of the square bracket shape are tapered) and the shape shown in FIG. 17 (both the ends of the square bracket shape are tapered and the tapered ends are folded). The reflecting plate 40 in the second embodiment may have the similar shape to those of the reflecting plates 20-10 and 20-11.

The typical embodiments of the present invention are described above, but the present invention can be embodied in various forms without departing from the spirit and the main characteristic defined by the claims of the present application. For this reason, the embodiments should be considered to be illustrative and not restrictive. The scope of the invention is indicated by the appended claims rather than by the description and the abstract. All variations and modifications within the range of equivalency of the claims are therefore intended to be embraced in the present invention.

The invention claimed is:

1. A sector antenna comprising:

a first printed circuit board for vertical polarized wave, the first printed circuit including a plurality of vertical polarized wave elements and a first feeder circuit connected to the plurality of vertical polarized wave elements;

a second printed circuit board for horizontal polarized wave, the second printed circuit board being mounted with a plurality of horizontal polarized wave elements and including a second feeder circuit connected to the plurality of horizontal polarized wave elements; and a reflecting plate which includes a concave section extending to one direction, wherein a cutout portion is provided between the adjacent two vertical polarized wave elements of the first printed circuit board, the first printed circuit board and the second printed circuit board are arranged parallel so that the horizontal polarized wave elements are arranged at the cutout portions of the first printed circuit board, the plurality of vertical polarized wave elements and the plurality of horizontal polarized wave elements are arranged alternately in the one direction inside the concave section.

2. The sector antenna according to claim 1, wherein each of the first printed circuit board and the second printed circuit board further includes a balun.

3. The sector antenna according to claim 1, wherein each of the feeder circuits includes a microstrip line.

4. The sector antenna according to claim 1, wherein the first and second printed circuit boards are arranged so as to be put through holes provided to the reflecting plate.

5. The sector antenna according to claim 1, wherein the reflecting plate has a substantially H-shaped cross section.

6. The sector antenna according to claim 1, wherein the reflecting plate has a substantially square bracket cross sectional shape.

7. The sector antenna according to claim 1, wherein a side wall of the reflecting plate constructing the concave section is thicker than a part except the side wall.

8. The sector antenna according to claim 1, wherein the reflecting plate partially includes a choke.

9. The sector antenna according to claim 1, wherein the vertical polarized wave elements are formed so as to tilt at a predetermined angle with respect to the one direction.

10. The sector antenna according to claim 1, wherein the first printed circuit board and the second printed circuit board are provided into the concave section of the reflecting plate.

11. The sector antenna according to claim 1, further comprising:

a support plate which supports the first printed circuit board and the second printed circuit board, wherein the support plate supports the first and second printed circuit boards and the reflecting plate.

12. The sector antenna according to claim 11, wherein the first printed circuit board, the second printed circuit board and the support plate are provided into the concave section of the reflecting plate.

13. The sector antenna according to claim 5, wherein two side plates of the reflecting plate are extended to a side opposite to an arrangement side of the vertical polarized wave elements and horizontal polarized wave elements.

14. The sector antenna according to claim 7, wherein two side plates of the reflecting plate are folded back at an arrangement side of the vertical polarized wave elements and horizontal polarized wave elements, and are extended to a side opposite to the arrangement side.

15. The sector antenna according to claim 14, further comprising a radome housing the first printed circuit board, the second printed circuit board, and the reflecting plate, wherein each extended portion of the two side plates of the reflecting plate is folded to stored in the radome.

* * * * *